US005803397A

United States Patent [19]

Chang

[11] Patent Number: 5,803,397

[45] Date of Patent: Sep. 8, 1998

[54] WET TISSUE ROLLING-UP DEVICE

[76] Inventor: Liang-Min Chang, P.O. Box 82-144, Taipei, Taiwan

[21] Appl. No.: 786,868

[22] Filed: Jan. 23, 1997

[51] Int. Cl.[6] ..... B65H 18/22

[52] U.S. Cl. ..... 242/535.1; 242/535.4; 242/541.2; 242/541.3

[58] Field of Search ..... 242/535.1, 535.4, 242/541.2, 541.3, 564.5, DIG. 3; 226/170, 171, 172, 173

[56] References Cited

U.S. PATENT DOCUMENTS

| | | | |
|---|---|---|---|
| 3,314,627 | 4/1967 | Wetzler | 242/535.1 |
| 3,519,214 | 7/1970 | Konrad et al. | 242/535.1 |
| 3,776,482 | 12/1973 | Mras | 242/541.3 |
| 4,431,124 | 2/1984 | Campbell et al. | 226/170 |
| 5,172,843 | 12/1992 | Unuma | 226/170 |
| 5,172,871 | 12/1992 | Schutt et al. | 242/535.1 |

*Primary Examiner*—John M. Jillions
*Attorney, Agent, or Firm*—A & J

[57] ABSTRACT

A wet tissue rolling-up device including a drive roller and a driven roller connected between two side boards, a conveying belt mounted around the drive roller and the driven roller and turned by the drive roller to deliver a wet tissue, and a guide belt surrounding the conveying roller and adapted for guiding delivered wet tissue, causing it to roll up into a wet tissue roll, wherein the conveying belt has a toothed inner wall, the drive roller and the driven roller hold a respective pair of ball bearings around a respective axle between the side boards and have a respective toothed outside wall meshed with the toothed inner wall of the conveying belt; a constraint device is mounted between the side boards to prohibit the conveying belt from moving sideways when the conveying belt is turned forwards by the drive roller.

1 Claim, 6 Drawing Sheets

WET TISSUE ROLLING-UP DEVICE

BACKGROUND OF THE INVENTION

1. Field of the Invention

This invention relates to a wet tissue rolling-up device adapted for use in a wet tissue processing machine to roll up moistened tissue into individual wet tissue rolls.

2. Description of the Prior Art

FIG. 1 shows the internal arrangement of a regular wet tissue processing machine. This machine comprises a tissue roll chamber 7, a water reservoir 72, a transmission roller 6, a tissue guide unit 5, a cutting wheel 4, a water sprayer 3, a motor drive 2, and a wet tissue rolling-up device 1. When a dry tissue roll 71 is mounted in the tissue roll chamber 7, the lead end of the tissue of the dry tissue roll 71 is pulled over the tissue transmission roller 6 below a top guide plate 51 of the tissue guide unit 5, then inserted through the gap between a bottom guide plate 52 of the tissue guide unit 5, and the cutting wheel 4 and a guide bar 53 of the tissue guide unit 5, and then inserted through a L-shaped moistening sliding way 31 and coupled to the wet tissue rolling-up device 1. When the machine is operated, the transmission roller 6 is turned by the motor drive 2 through a gear transmission to move the tissue forwards, permitting it to be cut by the cutting wheel 4 at a predetermined distance. The cut piece of tissue is moistened by water sprayed from a spray tube 32 of the water sprayer 3. The water sprayer 3 obtains water from the water reservoir 72, and sprays water through the spray tube 32 over the tissue passing through the L-shaped moistening sliding way 31. The moistened piece of tissue is then rolled up into a wet tissue roll by the wet tissue rolling-up device 1, and then delivered to an outlet at the bottom of the machine for service.

The aforesaid wet tissue rolling-up device 1, as shown in FIGS. 2 and 3, is comprised of a roller unit 11, two side boards 12, a conveying belt 13, and a guide belt 14. The roller unit 11 comprises a drive roller 111 and a driven roller 112 respectively coupled between the side boards 12. The conveying belt 13 is mounted around the drive roller 111 and the driven roller 112. The drive roller 111 and the driven roller 112 have a respective axle pad 114, and a respective axle 113 at the center of the axle pad 114. The axle 113 has two opposite ends respectively coupled to the side boards 12. A gear 1111 is fixedly mounted around the axle 113 of the drive roller 111 to receive driving power. Two tissue guides 121, 122 are connected between the side boards 12 in the middle, and pressed above the conveying belt 13. The guide belt 14 is covered over the conveying belt 13, having two locating plates 141 at two opposite ends, which are connected between the side boards 12 at different elevations. When a wet tissue is delivered into the gap between the guide belt 14 and the conveying belt 13, the gear 1111 is immediately driven by the aforesaid motor drive 2 to turn the drive roller 111, causing it to move the conveying belt 13. When the conveying belt 13 is moved, the intake piece of wet tissue is moved through the passage between the tissue guides 121, 122. When the wet tissue is moved through the passage between the tissue guides 121, 122, it is forced to roll up. Therefore, the wet tissue is rolled up into a wet tissue roll when it is continuously moved forward to the narrower gap at the front side between the conveying belt 13 and the guide belt 14. When the wet tissue roll is delivered over the bottom locating plate 141 of the guide belt 14, it immediately falls from the wet-tissue rolling-up device 1 through a bottom outlet thereof.

The aforesaid wet-tissue rolling-up device 1 is somewhat functional, however it still has drawbacks. One drawback of this structure of wet-tissue rolling-up device 1 is that the conveying belt 13 tends to move out of engagement with the roller unit 11 and to be jammed in the side boards 12 of the wet-tissue rolling-up device 1, causing the motor drive 2 to be damaged. Because the conveying belt 13 has a smooth inner side disposed in contact with the smooth periphery of the rollers 111, 112 of the roller unit 11, and the conveying belt 13 receives different transmission power from the rollers 111, 112, and because there is no constraint means to limit the conveying belt 13 from sideways displacement, the conveying belt 13 tends to deviate from the course and to be jammed in one side board 12 (see FIG. 5). If the motor drive 2 is continuously operated for a certain length of time when the conveying belt 13 is jammed, the motor drive 2 will burn out. Another drawback of this structure of wet tissue rolling-up device is that the conveying belt 13 cannot be positively moved at a constant speed. Because the conveying belt 13 has a smooth inner side disposed in contact with the smooth periphery of the rollers 111, 112 of the roller unit 11, it tends to slip, and cannot be positively moved at a constant speed. Furthermore, this structure of we tissue rolling-up device is not durable in use. Because the axles 113 of the rollers 111, 112 are mounted in the axle pads 114, the axle pads 114 wear quickly with use. When the axle pads 114 start to wear, the rollers 111, 112 become unable to function well, and shall have to be repaired or replaced.

SUMMARY OF THE INVENTION

This invention relates to a wet tissue rolling-up device adapted for use in a wet tissue processing machine to roll up moistened tissue into individual wet tissue rolls.

According to one aspect of the present invention, the wet tissue rolling-up device comprises drive roller and a driven roller connected between two side boards, a conveying belt mounted around the drive roller and the driven roller and turned by the drive roller to deliver a wet tissue, and a guide belt surrounding the conveying roller and adapted for guiding delivered wet tissue, causing it to roll up into a wet tissue roll, wherein the conveying belt has a toothed inner wall, the drive roller and the driven roller hold a respective pair of ball bearings around a respective axle between the side boards and have a respective toothed outside wall meshed with the toothed inner wall of the conveying belt. According to another aspect of the present invention, the drive roller and the driven roller each comprises a hollow cylindrical roller body, two plastic end caps at two opposite ends, two ball bearings respectively mounted within the plastic end caps, an axle mounted in the ball bearings within the plastic end caps and having two opposite ends respectively and fixedly connected to the side boards, and two pairs of friction rings respectively mounted around the axle at two opposite sides of each plastic end cap, the hollow roller body of the drive roller having one end fixedly mounted with a gear coupled to a motor drive. According to still another aspect of the present invention, a constraint device is mounted between the side boards to prohibit the conveying belt from moving sideways when the conveying belt is turned forwards by the drive roller.

DETAILED DESCRIPTION OF THE PREFERRED EMBODIMENT

Figure 1:
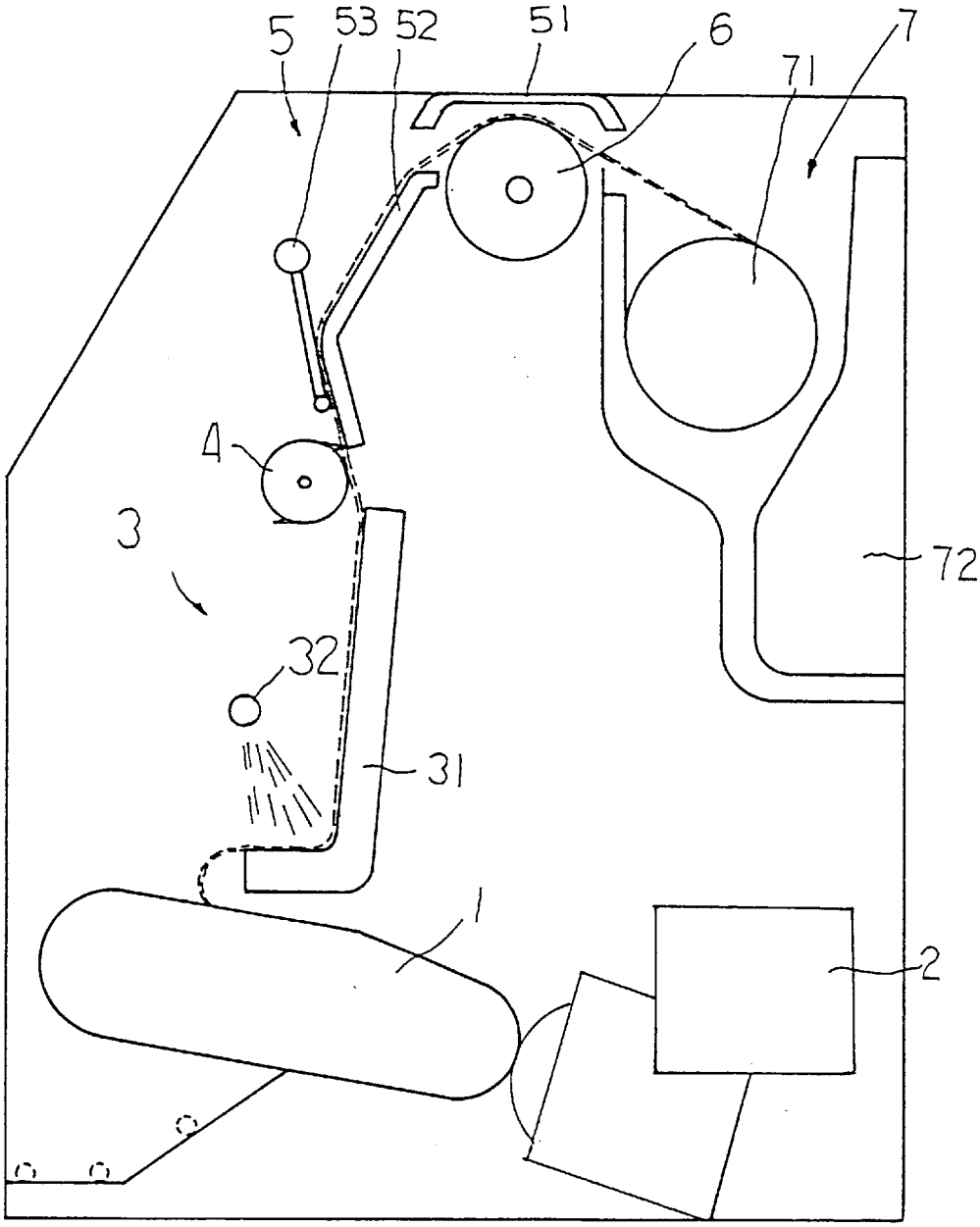
(PRIOR ART) FIG. 1
FIG. 1 shows the internal arrangement of a wet tissue processing machine according to the prior art.
Figure 2:
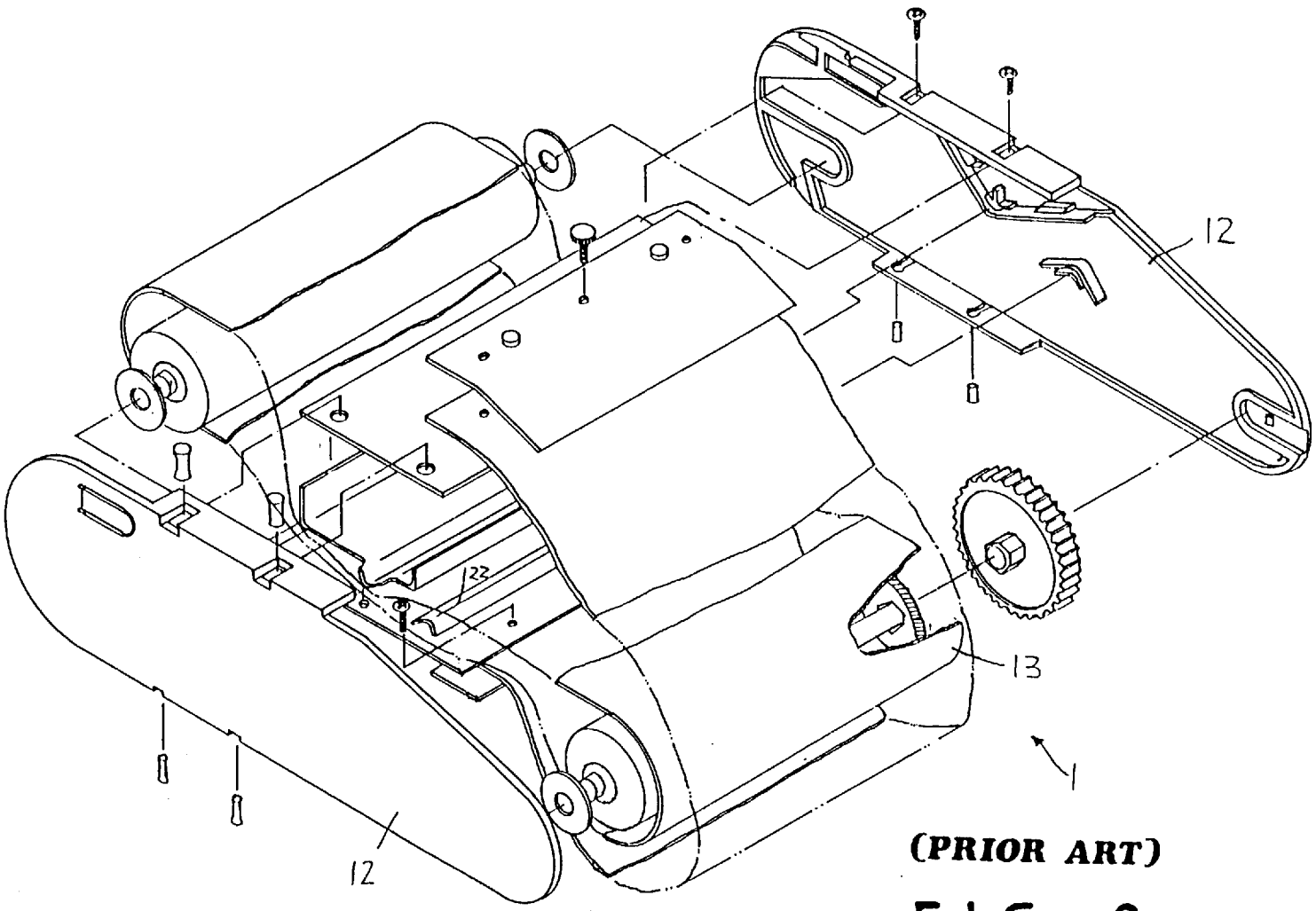
(PRIOR ART) FIG. 2
FIG. 2 is an exploded view of a wet tissue rolling-up device according to the prior art.
Figure 3:
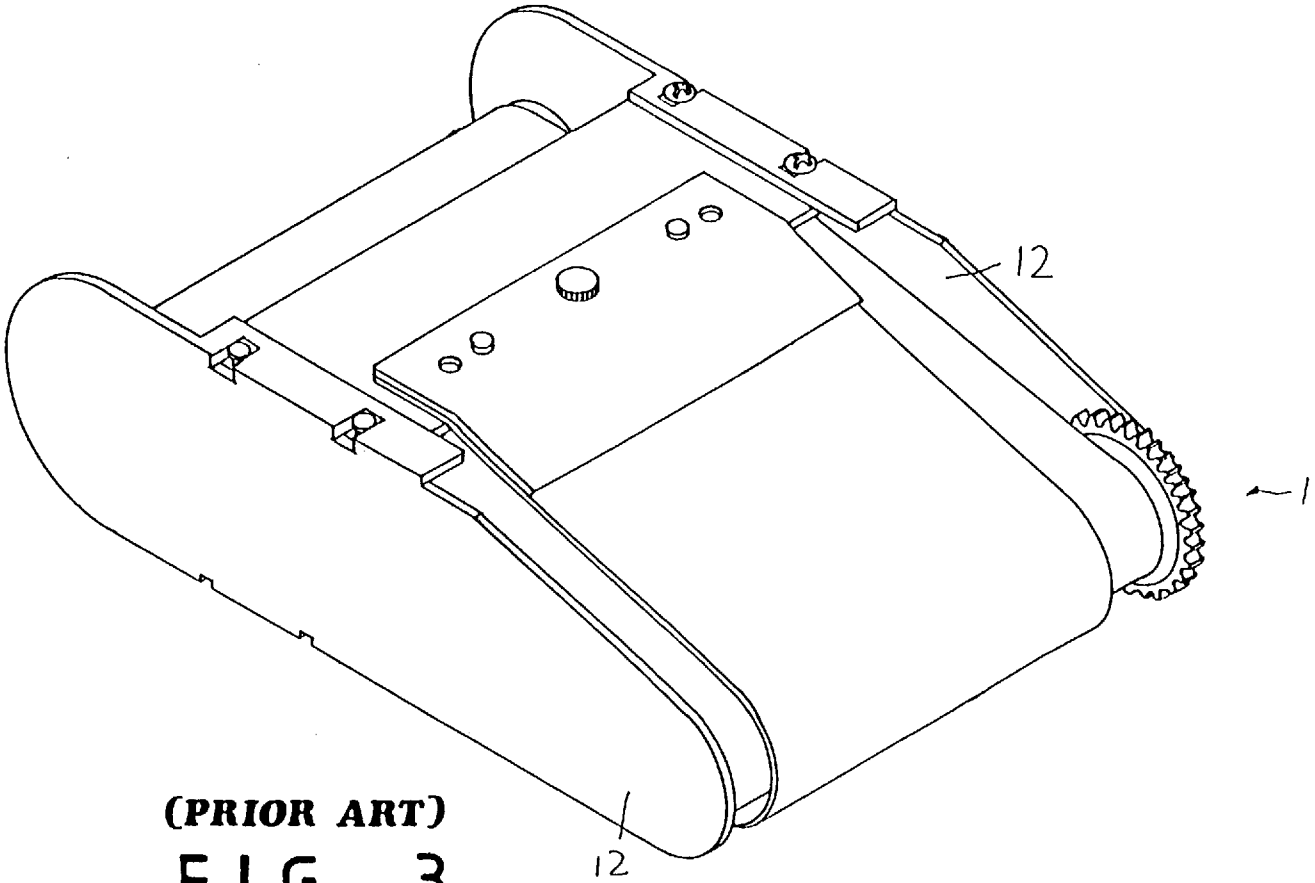
(PRIOR ART) FIG. 3
FIG. 3 is an elevational view of the wet tissue rolling-up device shown in FIG. 2.
Figure 5:
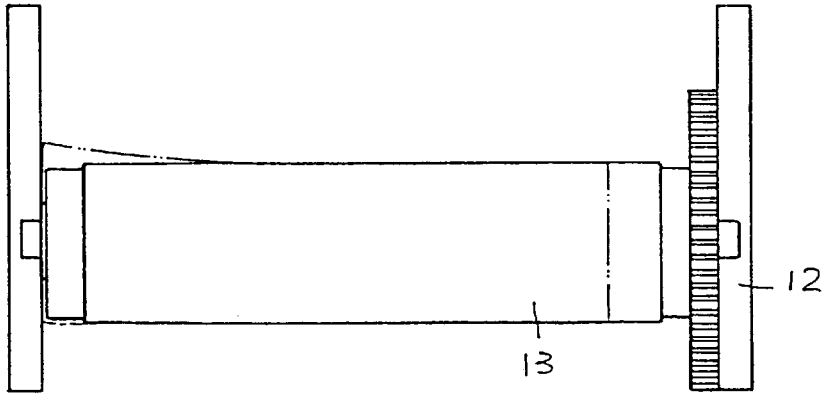
(PRIOR ART) FIG. 5
FIG. 5 is a front view of a part of the wet tissue rolling-up device of FIG. 2, showing the conveying belt deviated from course.
Figure 4:
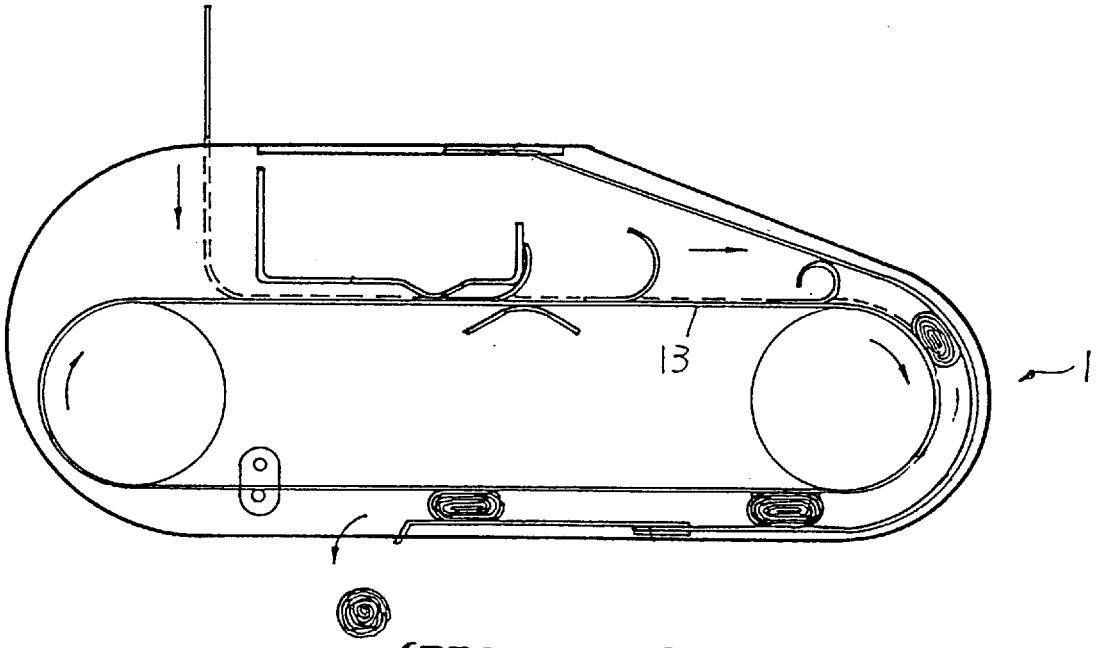
(PRIOR ART) FIG. 4
FIG. 4 is a side plain view of the wet tissue rolling-up device shown in FIG. 2 when operated.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 6:
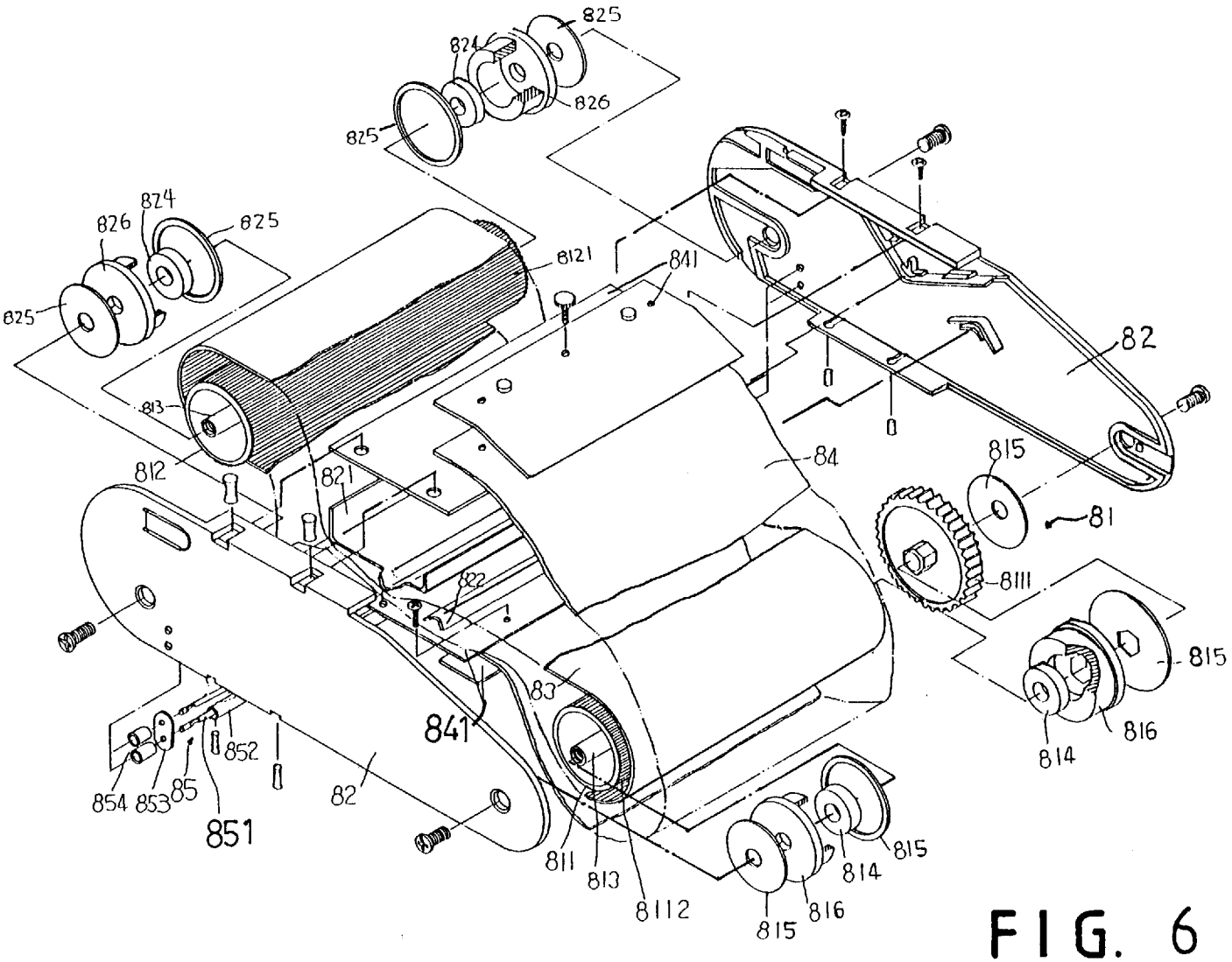
FIG. 6 is an exploded view of a wet tissue rolling-up device according to the present invention.
Figure 7:
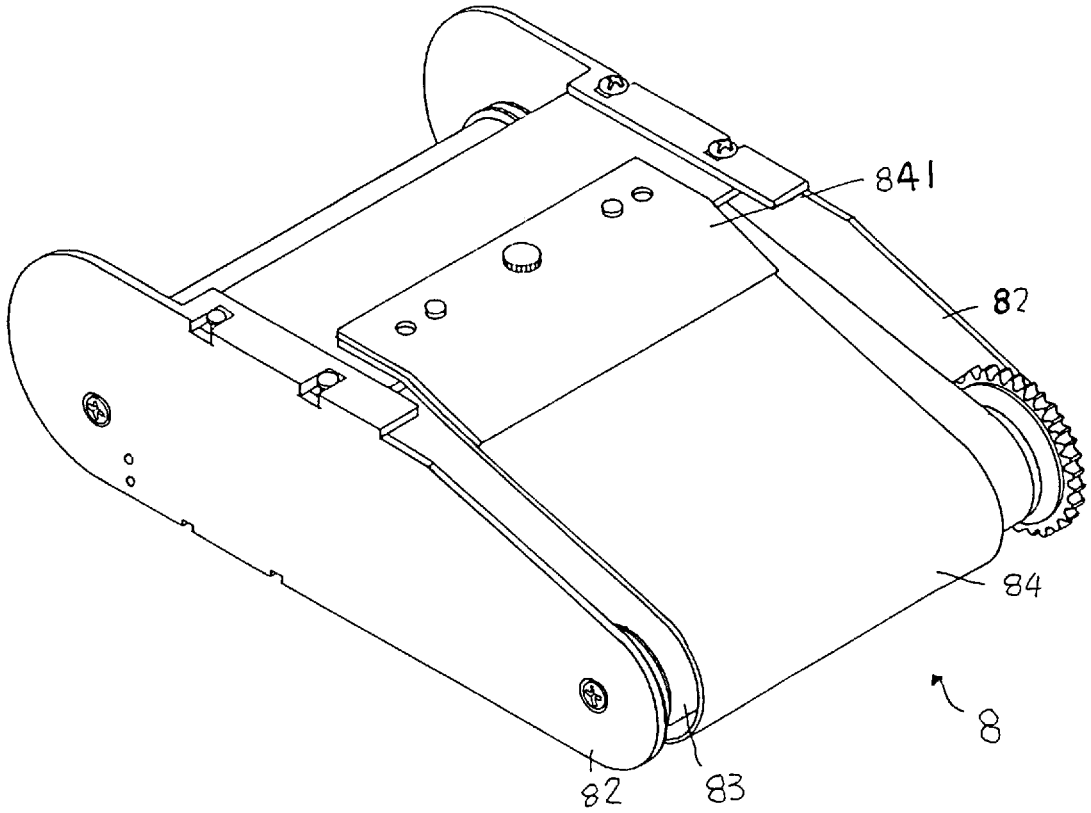
FIG. 7 is an elevational view of the wet tissue rolling-up device shown in FIG. 6.
Figure 8:
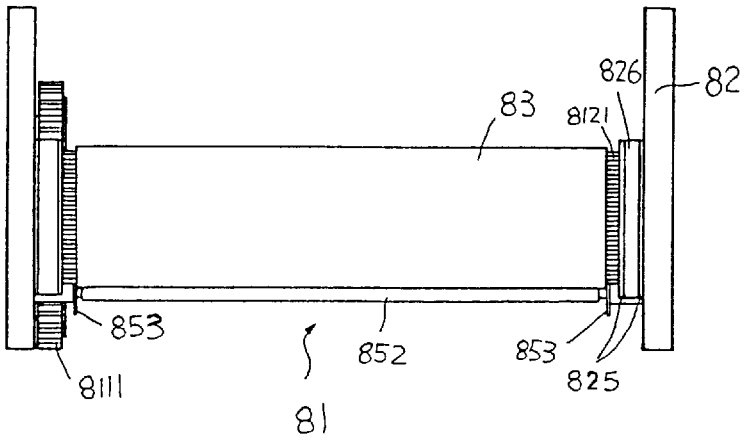
FIG. 8 is a front view of a part of the wet tissue rolling-up device of FIG. 6, showing the conveying belt maintained in course.

Referring to FIGS. 6, 7 and 8, a wet tissue rolling-up device 8 in accordance with the present invention is generally comprised of a roller unit 81, two side boards 82, a conveying belt 83, a guide belt 84, and a constraint device 85. The roller unit 81 comprises a drive roller 811 and a driven roller 812 respectively coupled between the side boards 82. The conveying belt 83 is mounted around the drive roller 811 and the driven roller 812. The drive roller 111 and the driven roller 112 are made of hollow structure, having a respective toothed outside wall 8112, 8121 meshed with the toothed inside wall 831 of the conveying belt 83. Two plastic end caps 816 or 826 are respectively fastened to two opposite ends of the roller 811 or 812. Two ball bearings 814 or 824 are respectively mounted within the plastic end caps 816 or 826 to hold an axle 813. The axle 813 has two opposite ends fixedly connected between the side boards 82. A friction plate 815 or 825 and a friction ring 8151 or 8251 are respectively mounted around the axle 813 and disposed at two opposite sides of each plastic end cap 816 or 826. A gear 8111 is mounted around the axle 813 of the drive roller 811 and fixedly connected to the drive roller 811 at one end, and adapted for receiving a rotary driving power. Two tissue guides 821, 822 are connected between the side boards 82 in the middle, and pressed above the conveying belt 83. The guide belt 84 is covered over the conveying belt 83, having two locating plates 841 at two opposite ends, which are connected between the side boards 82 at different elevations. The constraint device 85 comprises two locating rods 851 connected in parallel between the side boards 82 by locating rings 854, a revolving sleeve 852 sleeved onto one locating rod 851 and disposed in contact with the conveying belt 83 at the bottom, and two constraint plates 853 bilaterally coupled to the locating rods 851 and disposed in contact with two opposite side edges of the conveying belt 83 to stop the conveying belt 83 from moving sideways. When a wet tissue is delivered into the gap between the guide belt 84 and the conveying belt 83, the gear 8111 is immediately driven to turn the drive roller 811, causing it to move the conveying belt 83. When the conveying belt 83 is moved, the intake piece of wet tissue is moved through the passage between the tissue guides 821, 822. When the wet tissue is moved through the passage between the tissue guides 821, 822 it is forced to roll up. Therefore, the wet tissue is rolled up into a wet tissue roll when it is continuously moved forward to the narrower gap at the front side between the conveying belt 83 and the guide belt 84.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A wet tissue rolling-up device comprising a drive roller and a driven roller connected between two side boards, a conveying belt mounted around said drive roller and said driven roller and turned by said drive roller to deliver a wet tissue, and a guide belt surrounding said conveying roller and adapted for guiding delivered wet tissue, causing it to roll up into a wet tissue roll, wherein said conveying belt has a toothed inner wall; said drive roller and said driven roller each comprises a hollow cylindrical roller body having a toothed outside wall meshed with the toothed inner wall of said conveying belt, two plastic end caps at two opposite ends of said hollow cylindrical roller body, two ball bearings respectively mounted within said plastic end caps, an axle mounted in said ball bearings within said plastic end caps and having two opposite ends respectively and fixedly connected to said side boards, and two pairs of friction rings respectively mounted around said axle at two opposite sides of each plastic end cap, the hollow roller body of said drive roller having one end fixedly mounted with a gear coupled to a motor drive; a constraint device is mounted between said side boards to prohibit said conveying belt from moving sideways, said constraint device comprising two locating rods connected in parallel between said side boards by locating rings, a revolving sleeve sleeved onto one locating rod and disposed in contact with said conveying belt at a bottom side, and two constraint plates bilaterally coupled to said locating rods and disposed in contact with two opposite side edges of said conveying belt to stop said conveying belt from moving sideways.

* * * * *